US011230462B2

(12) United States Patent
Finkbeiner

(10) Patent No.: US 11,230,462 B2
(45) Date of Patent: Jan. 25, 2022

(54) LIFTING PLATFORM FOR LIFTING VEHICLES

(71) Applicant: Gerhard Finkbeiner, Freudenstadt (DE)

(72) Inventor: Gerhard Finkbeiner, Freudenstadt (DE)

( * ) Notice: Subject to any disclaimer, the term of this patent is extended or adjusted under 35 U.S.C. 154(b) by 139 days.

(21) Appl. No.: 16/603,845

(22) PCT Filed: Apr. 10, 2018

(86) PCT No.: PCT/EP2018/059087

§ 371 (c)(1),
(2) Date: Oct. 9, 2019

(87) PCT Pub. No.: WO2018/189138

PCT Pub. Date: Oct. 18, 2018

(65) Prior Publication Data

US 2020/0115205 A1 Apr. 16, 2020

(30) Foreign Application Priority Data

Apr. 13, 2017 (DE) ..... 102017108067.8

(51) Int. Cl.
*B66F 7/06* (2006.01)
*B66F 7/28* (2006.01)

(52) U.S. Cl.
CPC ..... *B66F 7/0641* (2013.01); *B66F 7/28* (2013.01)

(58) Field of Classification Search
CPC ..... B66F 7/0641; B66F 7/28
See application file for complete search history.

(56) References Cited

U.S. PATENT DOCUMENTS 2,533,980 A * 12/1950 Weaver ..... B66F 7/08 254/9 B
3,844,421 A * 10/1974 Nielsen ..... B66F 7/08 414/678

(Continued)

FOREIGN PATENT DOCUMENTS

DE 38 30 691 A1 3/1990
DE 36 05 650 C2 10/1994
WO 2007/128251 A1 11/2007

OTHER PUBLICATIONS

International Search Report and Written Opinion for corresponding Patent Application No. PCT/EP2018/059087 dated Jul. 23, 2018.

*Primary Examiner* — Tyrone V Hall, Jr.
(74) *Attorney, Agent, or Firm* — Renner, Otto, Boisselle & Sklar, LLP

(57) ABSTRACT

A lifting platform with two lifting devices distanced from one another and oriented to a common center axis of the lifting platform, with a working space for lifting/lowering vehicles therebetween. Each lifting device includes a vertically movable carrier. Each carrier receives at least two support arms, respectively pivotably-mounted about a pivot-axis on the carrier, the arms being orientable between a starting position parallel to the center axis to a use position in the working space. Each carrier longitudinal axis is parallel to the center axis, and a straight connecting line extends between the at least two pivot axes of each carrier to be oriented in an acute angle to the carrier longitudinal axis, such that two of the opposite pivot axes arranged to the center axis in a mirror-inverted manner have a greater distance to the center axis than the other at least two pivot axes of the carriers.

9 Claims, 7 Drawing Sheets

(56) References Cited

U.S. PATENT DOCUMENTS

Figure 1:
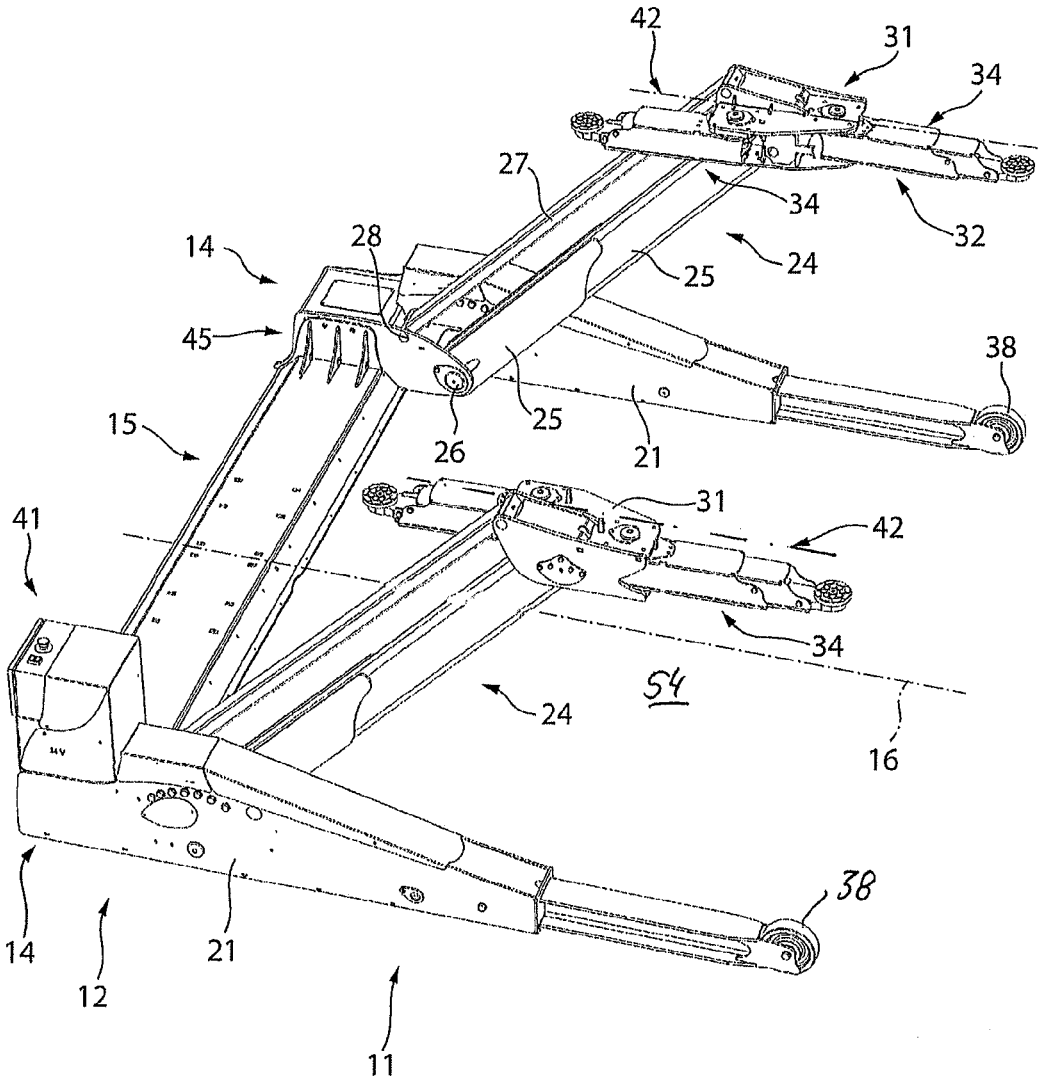

| | | | | | |
|---|---|---|---|---|---|
| 4,679,660 | A * | 7/1987 | Suzuki | B66F 7/28 | 187/219 |
| 4,798,266 | A | 1/1989 | Finkbeiner | | |
| 4,825,977 | A | 5/1989 | Isogai | | |
| 5,009,287 | A * | 4/1991 | Starr | B66F 7/04 | 187/213 |
| 5,825,977 | A | 10/1998 | Morin et al. | | |
| 5,954,160 | A * | 9/1999 | Wells, Sr. | B66F 7/04 | 187/219 |
| 6,182,796 | B1 * | 2/2001 | Perlstein | B66F 7/065 | 187/208 |
| 6,244,390 | B1 * | 6/2001 | Yeo | B66F 7/0666 | 187/205 |
| 6,814,342 | B1 | 11/2004 | Perlstein et al. | | |
| 9,840,402 | B2 * | 12/2017 | Horimizu | B66F 7/28 | |
| 2009/0188758 | A1 | 7/2009 | Grotz et al. | | |

* cited by examiner

LIFTING PLATFORM FOR LIFTING VEHICLES

The invention relates to a lifting platform for lifting vehicles.

A mobile hydraulic lifting platform for lifting vehicles in overhead height is known from DE 36 05 650 C2. This mobile lifting platform includes a base assembly which rests stationary when lifting vehicles. In non-use, this lifting platform can be moved, by means of a chassis, into a further use or storage position. The base assembly of the lifting platform includes two base assembly halves, as well as a middle part, wherein the two base assembly haves are firmly connected with one another, via the middle part, and arranged to one another. Each base assembly half comprises a drive, by means of which a parallelogram guiding device of the base assembly half is movable up and down. This parallelogram guiding device includes a load arm and a guide arm so that a carrier arranged on the free end region remains horizontally oriented in the lifting and lowering of the parallelogram guiding device. The carrier provided on the parallelogram guiding device receives two support arms pivotably arranged on the carrier. These support arms can be pivoted out of a non-use position, in which the support arms are oppositely oriented and are positioned parallel to the parallelogram guiding device, into a use position, in order to lift up a vehicle entered between the base assembly halves and into a working space of the lifting platform. For the entering of the vehicle into an entry region of the lifting platform, the support arms are oriented parallel to the longitudinal center axis of the lifting platform. The entry region has a constant width.

From U.S. Pat. No. 6,814,342 B1, a two-column lifting platform is known, in which a carrier is movable up and down along each lifting column. The carrier receives two support arms arranged pivotably thereon, onto which arms a running rail is provided. The two lifting columns are equally distanced to a common longitudinal center axis. Each of these lifting columns is turned outwardly with respect to the longitudinal center axis of the lifting platform, so that the two longitudinal axes of the two opposite carriers are oriented in a V-shape. The two pivot axes of the support arms lie in a straight connecting line which lies in the longitudinal axis of the carrier.

Moreover, a lifting platform is known from U.S. Pat. No. 5,825,977 B1, which platform consists of two lifting columns. A carrier is provided moveably up and down on each lifting column. On each carrier, in each case two support arms are arranged pivotably about a pivot axis. The lifting columns are oriented at the same distance to the longitudinal center axis, wherein each lifting column, with the carrier, is rotated by 90°, so that the carriers are not provided between the two lifting columns and point to the longitudinal center axis but are oriented rotated by 90°. In a non-use position, both support arms are oriented parallel to each other and are oriented parallel to the longitudinal center axis. The entry width of such a lifting platform is of constant width in such an above-described starting position.

The object underlying the invention is to suggest a lifting platform, in which an entry region for a vehicle in a working space of the lifting platform is enlarged.

This object is achieved by a lifting platform, in which two lifting devices oriented to a longitudinal center axis are provided, with in each case one carrier, which devices are movable up and down, wherein each carrier is oriented with its longitudinal axis parallel to the longitudinal center axis of the lifting platform, and the carrier receives at least two support arms respectively pivotably arranged about a pivot axis, on the carrier, and a straight connecting line, through the pivot axis of the support arms, is oriented in such a manner, in an acute angle to the longitudinal axis of the carrier, so that, in carriers arranged in a mirror-inverted manner to the longitudinal center axis, two opposing pivot axes have a greater distance to the longitudinal center axis than the at least one further pair of the opposing pivot axes of the carriers.

This arrangement makes it possible that an entry region, with respect to at least one pair of pivot axes oriented to the longitudinal center axis, have a greater distance to each other than the at least one second pair of further pivot axes arranged on the carrier. The pair of pivot axes can be outwardly offset, relative to a further pair of pivot axes, with respect to the longitudinal center axis. Thus, entering a working space of the lifting platform, which lies between the two carriers, with a vehicle can be easier. In addition, this arrangement has the advantage that both very short and very long vehicles will be securely received. Moreover, by this arrangement of the pivot axes of the support arms on the carrier, an enlarged pivot region of the support arms is provided, as these have a greater distance to the longitudinal center axis. The support arms, which are pivotable about the pivot axes arranged further apart from one another, can thereby be pivoted more steeply into the working space. In this context, under a steep angle, it can be understood that, starting from a starting position of the support arm, in which this arm is oriented parallel to the longitudinal center axis, a pivot angle of more than 60° can be pivoted in direction towards the longitudinal center axis.

A preferred configuration of the lifting platform provides that the longitudinal axis of the respective support arm extends between the two pivot axes for receiving the support arms. A compact and statically stable configuration can thereby be achieved.

Alternatively, the opposing pivot axes of the respective carrier can, with a greater distance, in each case be located outside a longitudinal axis of the carrier and the pivot axes of the support arms, which are at a reduced distance to one another, can respectively be located in the longitudinal axis of the carrier. In this configuration, an even larger entry region can be achieved.

Preferably, longer support arms are arranged on the pivot axes, which are arranged in a greater distance to the longitudinal center axis than the further pivot axes of the carrier. For example, a long and a short support arm can thus be provided on a carrier, which arms can selectively also be telescopable. By means of this arrangement can be received very long vehicles, for example. At the same time, a very short vehicle also can be received by means of the offset arrangement of the pivot axes by a lifting platform with long and short support arms, as the longer support arm, due to its outward offset relative to the shorter support arm, can take a different pivot angle position with respect to the vehicle than does the shorter support arm.

A first preferred embodiment of the lifting platform provides that a movable lifting platform comprises a stationary base assembly when lifting vehicles, which assembly includes two base assembly halves, which halves are preferably firmly arranged to one another, with a middle part, via in each case one connecting point, wherein the middle part is preferably detachably fastened on a lateral surface of a housing of the base assembly half, with a connecting portion, for forming the connecting point. A lifting device, in particular parallelogram guiding device or scissoring guide device, for example as half-scissors, scissors or double scissors, is provided on each base assembly half. This lifting device comprises a load arm and a guide arm, which are movable up and down, in particular by means of at least one drive arranged in at least one base assembly half. The carrier is provided in the respective end region of the lifting device. In this lifting platform, the entry region is opposite the middle part of the base assembly. That means that the opposite pivot axis of the support arms, which are at a reduced distance to one another, lie closer to the middle part.

An alternative configuration of the lifting platform provides that the lifting device is a single column lifting device, which comprises a base plate fastenable on the base or is provided on a lowerable chassis and includes a lifting column, along which the carrier is arranged movable up and down. Even in such an embodiment of the lifting platform, in which a lifting platform is formed by means of two opposing single-column-lifting devices or also multiple single column lifting devices along opposite one another in pairs, along a common longitudinal axis, can be configured such an enlarged entry area.

Figure 2:
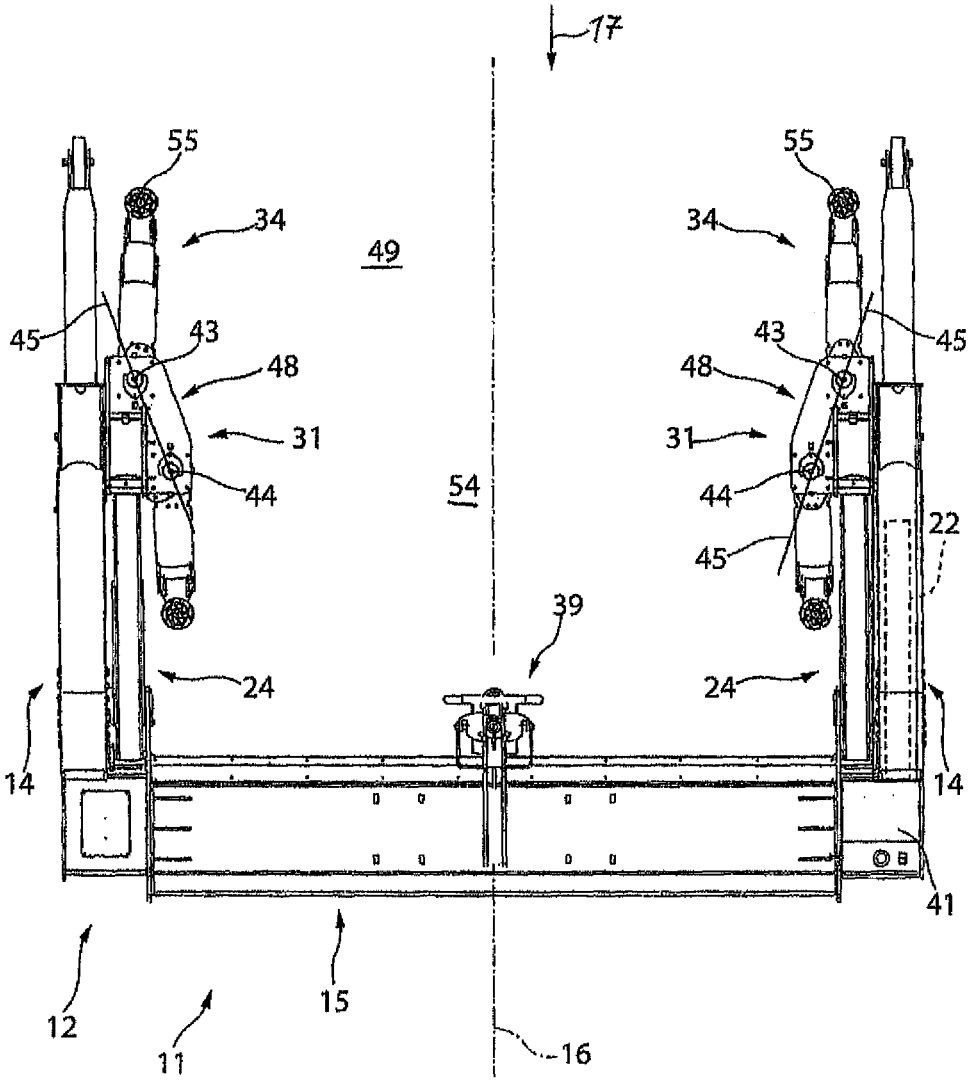
Figure 3:
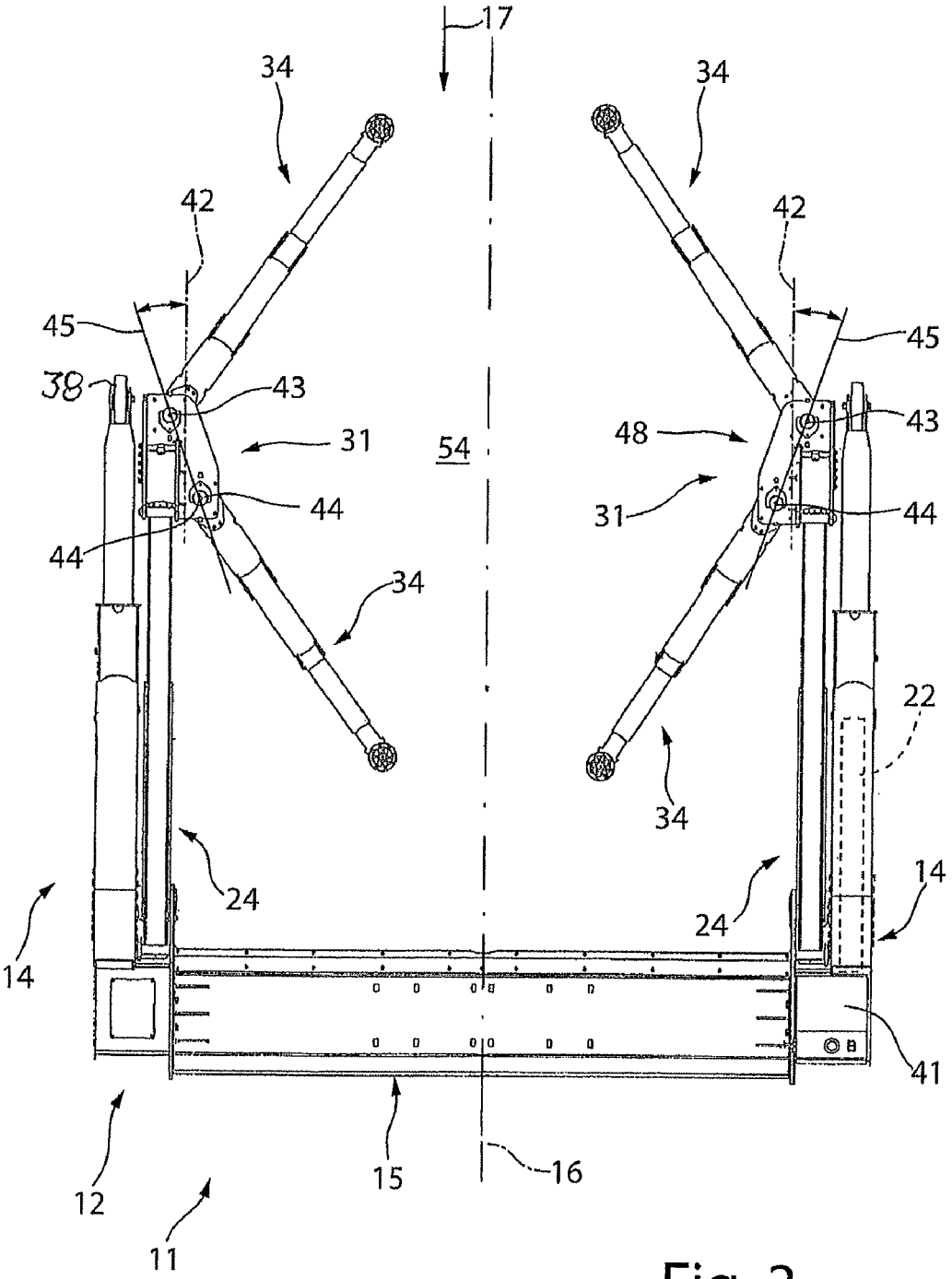
Figure 4:
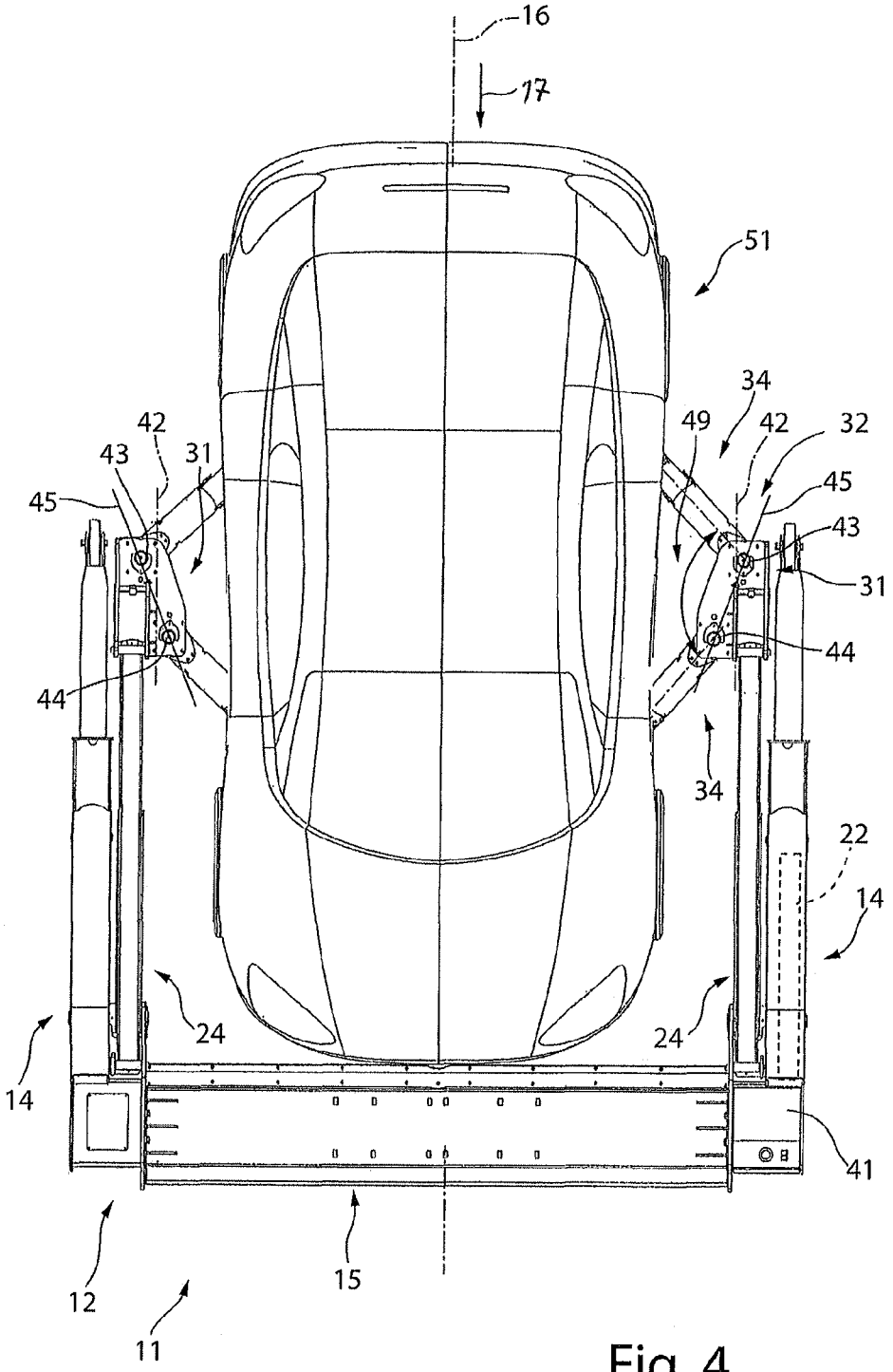
Figure 5:
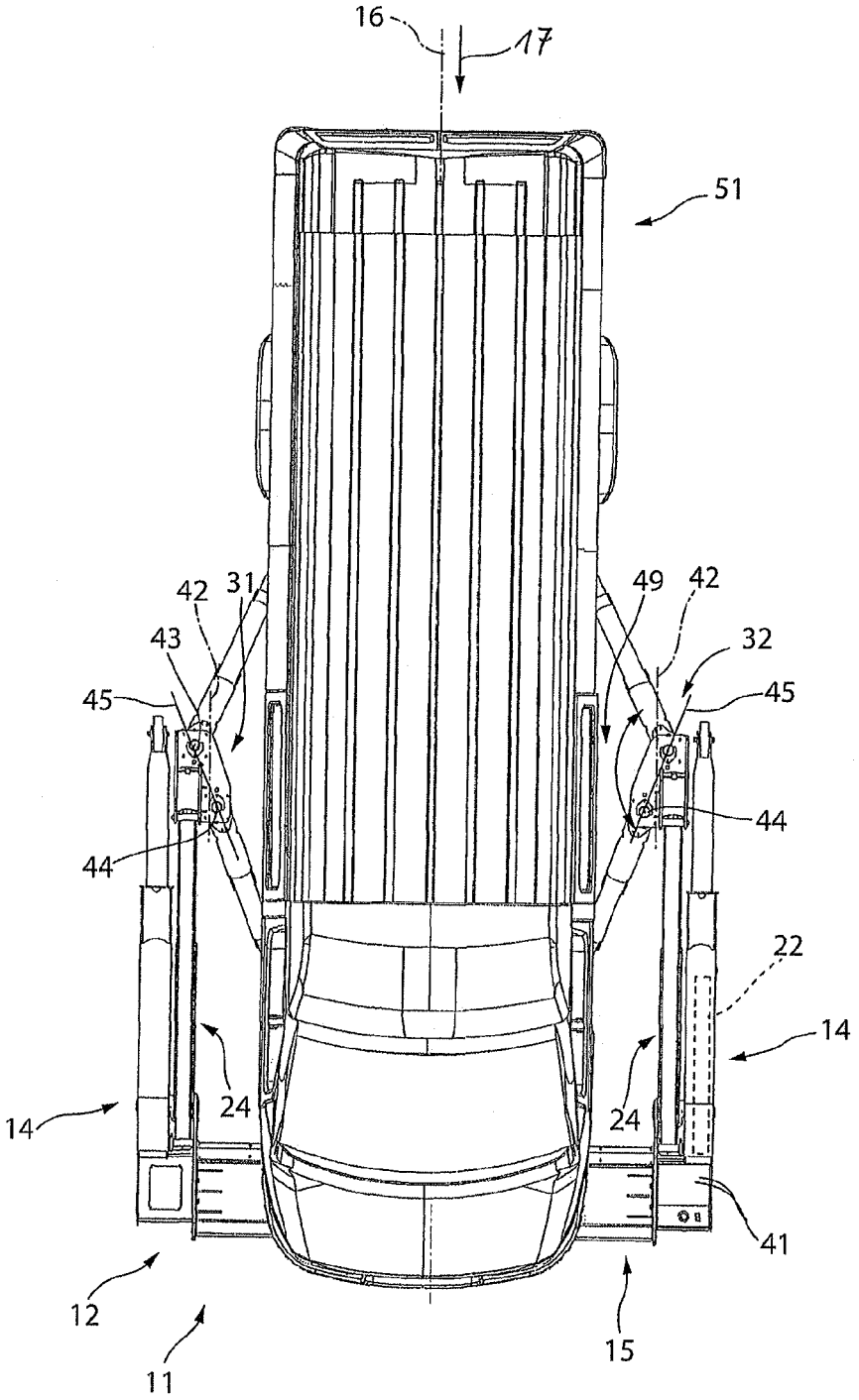
Figure 6:
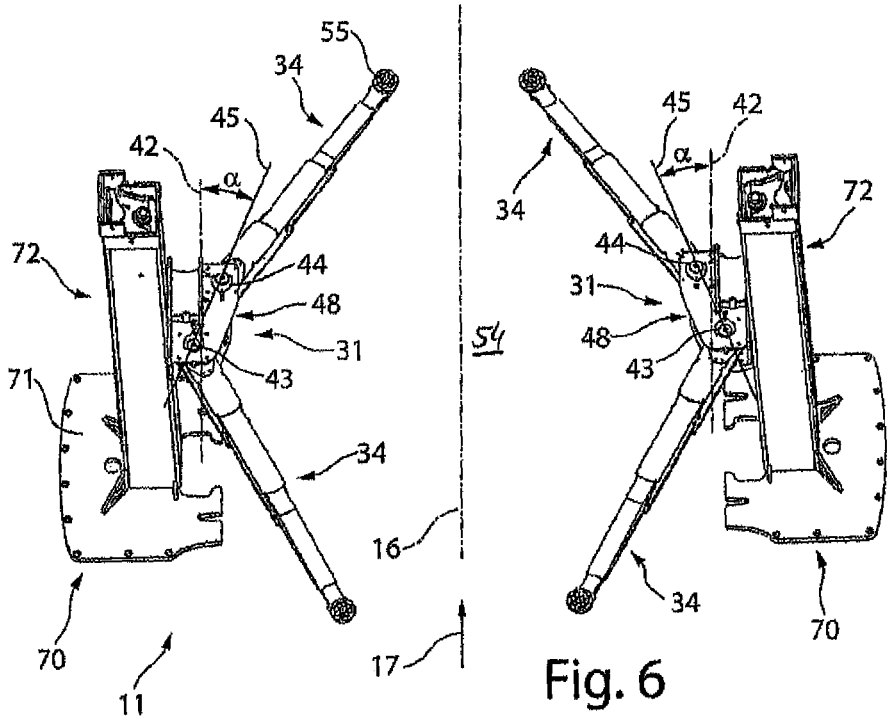
Figure 7:
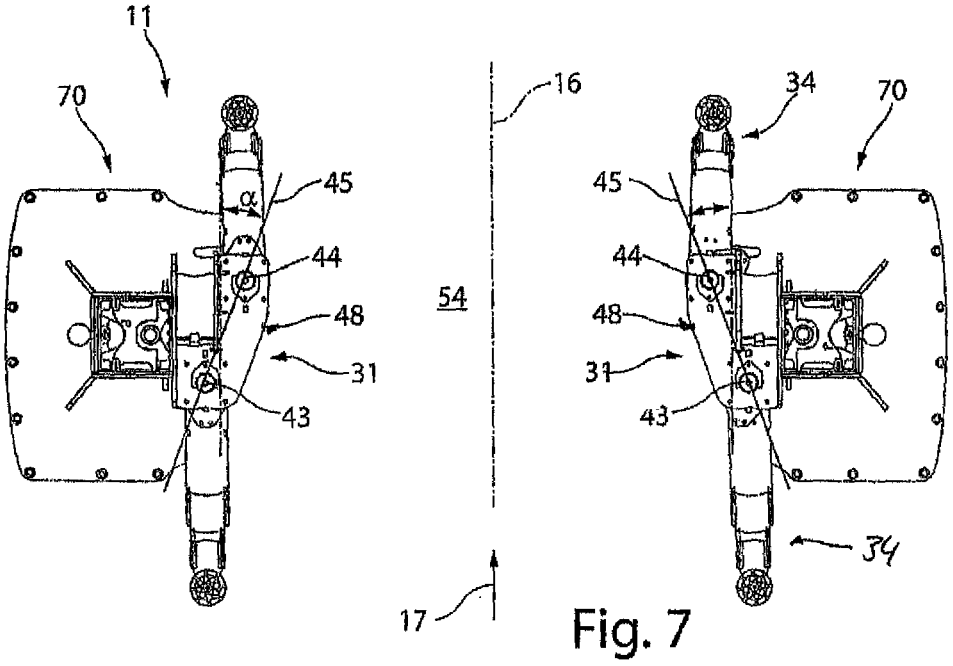
Figure 8:
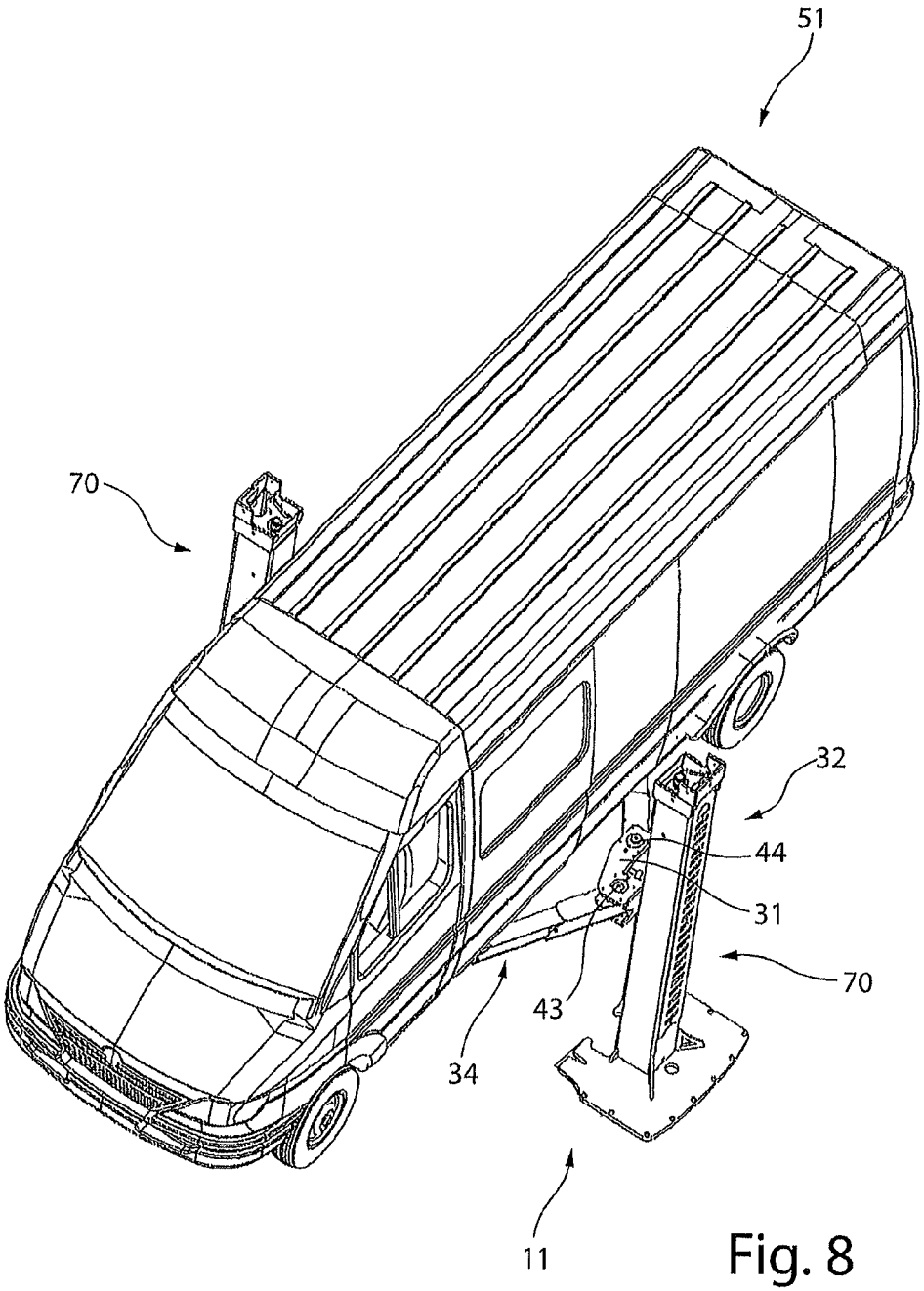

The invention as well as further advantageous embodiments and further developments of the same are described and disclosed in detail in the following based on the examples illustrated in the drawings. The features to be taken from the description and the drawings can be applied, according to the invention individually or in a plurality, in any combination. Shown are in:

FIG. 1 a perspective view of a first embodiment of the lifting platform according to the invention, FIG. 2 a schematic view from above onto the lifting platform according to FIG. 1, FIG. 3 a schematic view from above onto the lifting platform according to FIG. 2, with support arms extended and positioned in a working space, FIG. 4 a schematic view from above onto the lifting platform according to FIG. 2 with a short vehicle, FIG. 5 a schematic view from above onto the lifting platform according to FIG. 2 with a long vehicle, FIG. 6 a perspective view of an alternative embodiment of the lifting platform to FIG. 1, FIG. 7 a schematic view from above onto the lifting platform according to FIG. 6, and FIG. 8 a perspective view onto the lifting platform according to FIG. 6 with a lifted vehicle.

FIG. 1 shows a perspective view of a lifting platform 11 according to the invention. This lifting platform 11 includes a base assembly 12, which includes two base assembly halves 14 and a middle part 15 arranged therebetween. By means of the middle part 15, the base assembly halves 14 are preferably distanced and oriented parallel to one another. By means of the base assembly halves 14 and the middle part 15, a U-shaped base assembly 12 is formed. The open region constitutes an entry region 49 for a vehicle, to which adjoins a working space 54. The vehicle enters into the working space 54 for so long, until it is positioned close to the middle part 15. The entry direction is illustrated, according to arrow 17 in the plan view onto the lifting platform 11, in FIG. 2. The entry direction lies in the region of a longitudinal center axis 18 of the lifting platform 11. The longitudinal center axis 18 extends parallel between the two base assembly halves 14 and is centrally arranged thereto.

Each base assembly half 14 includes a housing 21, inside which a schematically illustrated drive 22 is provided. Moreover, each base assembly half 14 receives a lifting device 24 which, in this lifting platform, is configured as a parallelogram guiding device 24. Alternatively, the lifting device 24 can also be configured as a scissoring guide device. The at least one drive 22 lifts and lowers the parallelogram guiding device 24. This parallelogram guiding device 24 includes a load arm 25, which is pivotable about a first pivot axis 26. Moreover, the parallelogram guiding device 24 includes a guide arm 27, which is pivotable about a second pivot axis 28, which axis is distanced to the first pivot axis 26. Both pivot axes 26, 28 are mounted on the housing 21.

The parallelogram guiding device 24 comprises a carrier 31 on an end region remote to the housing 21, which carrier remains oriented horizontally, by means of the parallelogram guiding device 24, during the lifting and lowering of the parallelogram guiding device 24. In FIG. 1, the parallelogram guiding devices 24 are provided in a working position 32. Such a working position 32 can correspond to an overhead height. In a non-use position, the parallelogram guiding devices 24 are positioned oriented near the base or resting upon the base.

Each carrier 31 receives at least one support arm 34. Preferably, two support arms 34 are respectively provided on the carrier 31. These support arms 34 are pivotably mounted respectively about a bearing axis 43, 44. The support arms 34 can be configured of equal length. Alternatively, the rear support arm 34, facing towards the entry region 49, can be configured longer than the in particular front support arm 34 facing towards the middle part 15. The support arms 34 are preferably configured as telescoping support arms.

The lifting platform 11 is preferably configured as a movable lifting platform 11. Each base assembly half 14 preferably comprises a running roller 38 at an end distanced to the middle part 15, which roller is part of a carriage. Moreover, a drawbar 39 illustrated in FIG. 2 can be fastenable, in a middle region, to the middle part 15, so that after lifting the middle part 15, through the drawbar 39, the lifting platform 11 supports itself on a wheel of the drawbar 39 and the two running rollers 38. The lifting platform 11 is thereby mobile and can be movable to the respective site of use. After the removal of the drawbar 39, this lifting platform 11 is stationary and rests on the base.

Alternatively to the lifting platform 11 illustrated in FIG. 1, this platform can also be configured as a stationary lifting platform 11. In this case, the running rollers 38 can be dispensed with. In a stationary lifting platform 11, this platform can also consist of the two base assembly group halves 14 oriented towards one another. A middle part 15 can be provided or also be dispensed with.

To actuate the lifting platform 11 out of a non-use position into a working position 32, a controller 41 is provided which is arranged on one of the two base assembly halves 14, for example. This controller 41 can output a control signal to the respective drive(s) 22. The drive 22 can be a hydraulic cylinder which can be electrically actuated. A drive 22 is preferably provided in each housing 21 of the base assembly half 14. The controller 41 includes monitoring sensors for synchronization of the lifting and lowering movement of the respective lifting device 24. On the one hand, control lines can be guided from the controller 41 into the directly assigned base assembly half 14. On the other hand, control lines can be guided within the middle part 15 to the opposite base assembly half 14.

The carrier 31 comprises a longitudinal axis 42. This can be taken from the plan view in FIG. 2. Each support arm 34 is pivotably mounted on a carrier 42 about a pivot axis 43, 44. The pivot axes 43, 44 are distanced to one another. The carriers 31 which are arranged respectively on the lifting device 24, lie, viewed along the longitudinal center axis 16, at the same height and are distanced to one another at the same distance to the longitudinal center axis 16. The longitudinal axis 42 of the respective carrier 31 is oriented parallel to the longitudinal center axis 16. The pivot axes 43, 44 of the carrier 31 are on a straight connecting line 45. This straight connecting line 45 is oriented to the longitudinal axis 42 in an angle α. Here, the straight connecting lines 45 are oriented to each other in a V-shape. These straight connecting lines 45 are oriented facing in the direction towards the middle part 15 and towards the longitudinal center axis 16.

An entry region 49 is provided opposite the middle part 15. The entry region 49 is defined by a surface between the pivot axes 43, 44 of the opposed carriers 31. Two of the pivot axes 43 of the carrier 31, oriented to the longitudinal center axis 16 and opposite one another, have a greater distance to one another than to the further two pivot axes 44 on the carrier 31. Thereby, an enlarged entry region 49 is formed.

Through the pivot axes 43, 44 arranged offset to the longitudinal axis 42 of the carrier 31, an obliquely extending end face 48 can be configured on the carrier 31. This end face 48 extends preferably parallel to the straight connecting line 45. An enlarged entry region 49 can thereby be formed in the carriers 31 oriented to the longitudinal center axis 16. This entry region 49 can be configured in a funnel-shaped manner, in a view from above onto the carrier 31. The working space 54 of the lifting platform 11 is defined by the pivot region of the support arm 31 and, insofar as these are telescopable, by the extended support arms 31.

The straight connecting line 45 of the respective carrier 31 opens in the direction of the entry region 49. The distance of the opposite pivot axes 44 on the respective carrier 31 is greater than the distance of the further opposite pivot axes 44 of the respective carrier 31. The pivot axes 43 oriented to the entry region are thereby further offset outwards with respect to the longitudinal center axis 16 of the lifting platform 11. The support arm 34, which is received by the pivot axes 43 further offset outwards can thereby be oriented, in a non-use position, as this is illustrated in FIG. 2, parallel to the longitudinal center axis 16, so that these support arms 34 facing the entry region 49, are distanced further to one another than the support arms 34 facing the middle part 15, which arms are arranged on the respective further pivot axes 44 of the carrier 31.

The support arms 34 can have a predefined length. Alternatively, one or both support arms 34 arranged on the carrier 31 can be configured telescopable.

FIG. 3 illustrates the lifting platform according to FIG. 2, with support arms 34, extended and pivoted into the working space 54. Preferably, in this lifting platform 11, the one support arm 34 provided on the carrier 31, which arm is pivotable about the pivot axis 34, is arranged on the carrier 31, spaced from the middle part 15, or configured to be longer than the further support arm 34, which is mounted pivotably on the carrier 31 by the means of the pivot bolt 44. This can apply to a fixedly selected length of the support arms 34, as well as to telescopable support arms 34.

In FIG. 4 illustrates a schematic view from above onto the lifting device 11 according to FIG. 2, with a thereupon-positioned short vehicle 51, in a working position 32 of the lifting platform 11. According to arrow 17, the vehicle is entered into a working space 54 via the entry region 49. Here, the support arms 34 are in a non-use position, as this is illustrated in FIG. 2. Subsequently, the support arms 34 are pivoted into the working space 54, as can be taken from FIG. 3. The support arms 34 are here pivoted under the vehicle 51, so that supporting elements 55, on support arms 34, act upon the load application points of vehicles 51, in particular, in the vehicle sill region. From the plan view in FIG. 4, it is obvious, that the support arms 34, which are arranged on the pivot axes 43, which have a greater distance to the longitudinal center axis 16, assume a greater pivot angle in direction onto the longitudinal center axis 16 as this is provided in the further support arms 34, which are mounted on the pivot axes 44, which have a smaller distance to the longitudinal center axis 16.

FIG. 5 illustrates a view from above onto the lifting platform 11 according to FIG. 2, which platform receives a long vehicle 51 in a working position 32 of the lifting platform 11. Due to the telescopability, the support arms 34 are extended, so that the supporting elements 55 of the respective support arms 31, in turn, can act on the load application points of the vehicle 51, in particular, in the sill region.

A comparison of the positions of the support arms 34, on the one carrier 31, in the short vehicle 51 according to FIG. 3 and on the long vehicle 51 according to FIG. 5 shows that the flexibility in the receiving of long and short vehicles 51 is maintained by means of the offset arrangement of the pivot axes 43, 44 on a carrier 31. By contrast, the entry region 49 is larger in the region of the opposite pivot axes 43 of the carriers 31 than in the region of the further pivot axes 44 on the carriers 31.

FIG. 6 illustrates a perspective view of an alternative embodiment of the lifting platform 11 to FIG. 1. This lifting platform 11 includes two lifting devices, which are respectively configured as a single-column lifting device 70. These single-column lifting platforms 70 are oriented to one another. These single-column-lifting devices 70 are arranged at the same distance to the longitudinal center axis 16. The single-column-lifting device 70 comprises a base plate, by which said lifting device is firmly fixed to the base. Instead of the base plate, a movable chassis can also be provided, which is lowerable onto the base, before or when lifting the vehicle 51. This single-column lifting device 70 includes a lifting column 72, along which the carrier 31 is movable up and down by means of a drive not illustrated in further detail, which drive is driven via a non-illustrated controller. A longitudinal axis 42 of the carrier 31 is oriented parallel to the longitudinal center axis 16. The construction of the carrier 31, as well as the arrangement of the pivot axes 43, 44 on the respective carrier 31 and orientation thereof to the longitudinal center axis 16 corresponds to the embodiments relating to the lifting platform 11 according to FIGS. 1 to 4, so that reference is made in its entirety to said FIGS.

FIG. 7 illustrates a schematic view from above onto the alternative embodiment of the lifting platform 11 according to FIG. 6 is illustrated. The support arms 34 are provided on the carrier 31 in a non-use position, that means, that the support arms 34 are oriented in parallel to the longitudinal center axis 16. The vehicle 51, according to arrow 17, can be positioned between the two single-column lifting devices 70 via the entry region 49. Subsequently, the support arms 34 are pivoted under the vehicle 51 to engage on the load application points of the vehicle 51. A subsequent lifting of the vehicle 51 transfers the same into a working position 32, which is illustrated in FIG. 8.

The invention claimed is:

1. A lifting platform comprising two lifting devices arranged at a distance to one another, the two lifting devices being oriented towards a common longitudinal center axis of the lifting platform and between which a working space for lifting and lowering of vehicles is provided, wherein each lifting device comprises a carrier which is movable up and down, and each carrier includes at least two support arms, which are respectively mounted pivotably about at least two pivot axes on the carrier, so that the at least two support arms of each carrier are orientable parallel to the longitudinal center axis in a starting position and are pivotable into the working space between the carriers in a use position, wherein a longitudinal axis of each carrier is oriented parallel to the longitudinal center axis, and a straight connecting line of each carrier, extends through the at least two pivot axes of each carrier, and the at least two pivot axes of each carrier are arranged at a distance from each other in such a manner that the straight connecting line of each carrier is oriented at an acute angle to the longitudinal axis of each carrier, and at least a first pivot axis of the at least two pivot axes of each carrier has a greater distance to the longitudinal center axis than at least a second pivot axis of the at least two pivot axes of each carrier, and wherein opposite ones of at least the first and/or second pivot axes of the respective carriers are arranged opposite one another on the respective carriers in a mirror-inverted manner relative to the longitudinal center axis.

2. The lifting platform according to claim 1, wherein the longitudinal axis of each carrier extends between the at least two pivot axes arranged offset to one another.

3. The lifting platform according to claim 1, wherein the second pivot axis of each carrier lies in the longitudinal axis of the carrier.

4. The lifting platform according to claim 1, wherein longer support arms are arranged on the first pivot axes of the respective carriers, which are arranged at a greater distance to the longitudinal center axis of the lifting platform, than the support arms arranged on the second pivot axes of the respective carriers.

5. The lifting platform according to claim 1, wherein the lifting platform, when lifting vehicles, comprises a stationary base assembly, which includes two base assembly halves, which are arranged to one another via a connecting point, with a middle part and with in each case one lifting device arranged on the base assembly half.

6. The lifting platform according to claim 5, wherein the lifting device is configured as parallelogram guiding device or as scissoring guide device.

7. The lifting platform according to claim 5, wherein two base assembly halves are arranged releasable via the connecting point with the middle part.

8. The lifting platform according to claim 5, wherein the lifting device includes a load arm and a guide arm, which are, with at least one drive arrange in a base assembly half, transferable from a starting position arranged on the base into a working position and respectively receive the carrier in an end region of the lifting device.

9. The lifting platform according to claim 1, wherein the lifting device is configured as a single-column lifting device, which comprises a base plate fastenable on the base or a lowerable chassis and includes a lifting column arranged thereon, along which the carrier is arranged movable up and down.

* * * * *